US012733781B2

(12) United States Patent
Cho et al.

(10) Patent No.: US 12,733,781 B2
(45) Date of Patent: Sep. 15, 2026

(54) CLEANING DEVICE

(71) Applicant: SAMSUNG ELECTRONICS CO., LTD., Suwon-si (KR)

(72) Inventors: Youngjun Cho, Suwon-si (KR); Ohkyu Kwon, Suwon-si (KR); Dongjin Cho, Suwon-si (KR); Seongtae Chu, Suwon-si (KR); Hyeonwoo Tak, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 384 days.

(21) Appl. No.: 18/216,714

(22) Filed: Jun. 30, 2023

(65) Prior Publication Data

US 2023/0337877 A1 Oct. 26, 2023

Related U.S. Application Data

(63) Continuation of application No. PCT/KR2022/001419, filed on Jan. 27, 2022.

(30) Foreign Application Priority Data

Mar. 23, 2021 (KR) ..... 10-2021-0037367

(51) Int. Cl.
*A47L 9/14* (2006.01)
*A47L 9/24* (2006.01)

(52) U.S. Cl.
CPC ..... *A47L 9/1427* (2013.01); *A47L 9/1481* (2013.01); *A47L 9/242* (2013.01)

(58) Field of Classification Search
CPC ..... A47L 9/2863; A47L 9/2857; A47L 9/32; A47L 9/322; A47L 9/325; A47L 9/327;
(Continued)

(56) References Cited

U.S. PATENT DOCUMENTS 7,175,682 B2 2/2007 Nakai et al.
8,947,890 B2 2/2015 Tachikawa et al.
(Continued)

FOREIGN PATENT DOCUMENTS

CN 201418719 Y 3/2010
CN 107928549 A * 4/2018 ..... A47L 9/327
(Continued)

OTHER PUBLICATIONS

Espacenet Description JP2019136337A; Extension Pipe of a Vacuum Cleaner; Aug. 22, 2019 (Year: 2019).*
(Continued)

*Primary Examiner* — Brian D Keller
*Assistant Examiner* — Sidney D Full
(74) *Attorney, Agent, or Firm* — STAAS & HALSEY LLP

(57) ABSTRACT

A cleaning device comprises: a housing having a dust collection chamber; a main body, moveable with respect to the housing, to be coupled to the housing and to be decoupled from the housing, the main body includes a handle; a fixing device, arrangeable in the main body, to couple the main body to the housing to the housing while the main body is moved to a first position with respect to the housing and to decouple the main body from the housing while the main body is moved to a second position with respect to the housing; and a releasing button arrangeable with respect to the main body, and connectable to the fixing device by a wire so that while the release button is connected to the fixing device, the release button is useable to operate the fixing device.

14 Claims, 13 Drawing Sheets

(58) Field of Classification Search
CPC . A47L 9/24; A47L 9/242; A47L 9/244; A47L 9/248; A47L 9/106; A47L 9/108; A47L 9/1463; A47L 9/1691; A47L 9/1481; A47L 9/1427; A47L 5/225; A47L 5/24; A47L 5/28; A47L 5/32
USPC ..... 15/334, 335
See application file for complete search history.

(56) References Cited

U.S. PATENT DOCUMENTS

| | | | | |
|---|---|---|---|---|
| 11,089,936 | B2 | 8/2021 | Ham et al. | |
| 11,116,373 | B2 | 9/2021 | Hyun et al. | |
| 11,191,406 | B2 | 12/2021 | Cho et al. | |
| 11,647,882 | B2 | 5/2023 | Cho et al. | |
| 2014/0237752 | A1* | 8/2014 | Conrad | A47L 9/2847 15/353 |
| 2019/0008337 | A1* | 1/2019 | Lim | A47L 5/225 |

FOREIGN PATENT DOCUMENTS

| | | | | | |
|---|---|---|---|---|---|
| CN | 212234347 | U | | 12/2020 | |
| JP | 5-68461 | | | 9/1993 | |
| JP | H0568461 | U | * | 9/1993 | |
| JP | 4047262 | | | 2/2008 | |
| JP | 2008-80042 | | | 4/2008 | |
| JP | 4090976 | | | 5/2008 | |
| JP | 5208181 | | | 3/2013 | |
| JP | 2014-223109 | | | 12/2014 | |
| JP | 5696475 | | | 4/2015 | |
| JP | 2019-136337 | | | 8/2019 | |
| JP | 2019-146876 | | | 9/2019 | |
| JP | 2020-18617 | | | 2/2020 | |
| JP | 2020156843 | A | * | 10/2020 | A47L 9/242 |
| JP | 2020-189136 | | | 11/2020 | |
| JP | 7117111 | | | 8/2022 | |
| KR | 10-2018-0076257 | | | 7/2018 | |
| KR | 10-2019-0024515 | | | 3/2019 | |
| KR | 10-2019-0066239 | | | 6/2019 | |
| KR | 10-2021922 | | | 9/2019 | |
| KR | 10-2020-0107756 | | | 9/2020 | |
| KR | 10-2188510 | | | 12/2020 | |
| KR | 10-2293353 | | | 8/2021 | |

OTHER PUBLICATIONS

Espacenet Description JP-H0568461; Vacuum Cleaner; Sep. 17, 1993 (Year: 1993).*
Espacenet Description CN 107928549; Dust Collector; Bian, Xiaoxian; Apr. 20, 2018 (Year: 2018).*
JP-2020156843 PE2E Translation; Onishi Yuji; Extension Pipe of Vacuum Cleaner and Vacuum Cleaner Comprising the Same; Oct. 1, 2020 (Year: 2020).*
International Search Report dated May 20, 2022 in International Patent Application No. PCT/KR2022/001419.
PCT/ISA/237 dated May 20, 2022 in International Patent Application No. PCT/KR2022/001419.
Office Action dated Mar. 27, 2026, issued in Korean Application No. 10-2021-0037367.

* cited by examiner

CLEANING DEVICE

CROSS-REFERENCE TO RELATED APPLICATION

This application is a continuation application, under 35 U.S.C. § 111(a), of international application No. PCT/KR2022/001419, filed on Jan. 27, 2022, which claims priority under 35 U. S. C. § 119 to Korean Patent Application No. 10-2021-0037367, filed Mar. 23, 2021, the disclosures of which are incorporated herein by reference in their entireties.

BACKGROUND

Field

The present disclosure relates to a cleaning device having an improved structure for a user's convenience.

Description of Related Art

A cleaning device is an appliance for cleaning an indoor space by removing rubbish from the indoor space. Generally, vacuum cleaners are commonly used in home. The vacuum cleaner cleans an indoor space by sucking air with a suction force by a fan motor unit and then separating rubbish in the sucked air through a device such as a filter. Vacuum cleaners are classified into a canister type and an upright type. Recently, a robot cleaner that itself travels on a cleaning area without a user's control to perform a cleaning operation by sucking rubbish such as dust from a floor to be cleaned is popularized.

The vacuum cleaner includes a suction head for sucking rubbish such as hair on a floor to be cleaned by a suction force of air, a housing connected to the suction head, and a main body that is movable inside the housing.

The main body includes a dust collector therein to filter rubbish included in the sucked air through the filter. The dust collector is provided at one side of the main body and accommodated inside the housing. The main body includes a handle which a user grips to perform cleaning. The handle is provided at another side of the main body to be exposed to the outside.

To discharge rubbish, etc. filtered by the dust collector to the outside, the main body needs to be taken out of the housing. The main body is fixed to the housing by a fixing device, and the fixing device operates by a button provided in the housing. That is, according to pressing of the button by a user, the fixing device is separated from the housing to enable the user to take the main body out of the housing.

However, because the button that has to be pressed by a user to separate the main body from the housing is positioned in the housing, the user has difficulties in pressing the button with his/her one hand while gripping the handle with the other hand.

SUMMARY

A cleaning device according to an embodiment of the disclosure may include: a housing including a dust collecting chamber; a main body, moveable with respect to the housing, to be coupled to the housing and to be decoupled from the housing, the main body including a handle; a fixing device, arrangeable in the main body, to couple the main body to the housing while the main body is moved to a first position with respect to the housing and to decouple the main body from the housing while the main body is moved to a second position with respect to the housing; and a release button, arrangeable with respect to the main body, and connectable to the fixing device by a wire, so that while the release button is connected to the fixing device, the release button is useable to operate the fixing device.

The fixing device, while arranged in the main body to couple the main body to the housing, the fixing device may be positionable an end of the housing to which the main body is to be coupled, and a distance between the end of the housing to the release button is shorter than a distance between another end of the housing to the release button.

While one end of the main body may be coupled to the housing and accommodated inside the housing, the handle may be at the other end of the main body.

The release button may be at the handle adjacent to the other end of the main body.

The release button may include a button case fixed to the main body, and a button portion moveable with respect to the button case, to be coupled to the button case and be decoupled from the button case.

The button case may include a pair of support ribs to support the wire, a wire fixing portion configured to fix an end of the wire to one of the pair of support ribs, and a guide hole configured to guide the button portion to be movable with respect to the button case.

The button portion may include a push portion exposed to an outside of the main body, a guide protrusion, insertable in the guide hole, the guide protrusion being configured to guide the button portion to be movable with respect to the button case, and a push rib to protrude from the push portion to be positioned between the pair of support ribs and support the wire.

The housing may include a fixing portion including a fixing groove to which the fixing device is coupled.

The fixing device may include a holder case coupleable to the main body, a wire holder, to which an end of the wire is coupleable, which is moveable while accommodated in the holder case, a fixing pipe, arrangeable inside the holder case, moveable along an up-down direction with respect to the wire holder according to a movement of the wire holder by the wire, and a spring between the fixing pipe and the holder case.

The holder case may include a coupling portion coupleable to the main body, a guide rail configured to guide the wire holder to be movable with respect to the holder case, a penetration portion which the wire penetrates such that an end of the wire is coupled to the wire holder, and an opening which opens to enable the wire holder to move with respect to the holder case.

The wire holder may include a wire fixing groove to which an end of the wire is fixed, a guide rib, to be guided along the guide rail, the guide rib being configured to enable the wire holder to move with respect to the holder case, a through hole, which the fixing pipe penetrates, the fixing pipe being movable along an up-down direction, and an inclined surface configured to move the fixing pipe in the up-down direction according to a movement of the wire holder while being in contact with the fixing pipe.

The inclined surface may be a first inclined surface, and the fixing pipe may include a fixing protrusion fixed to the fixing groove, a spring support portion on which one side of a spring is supported, and a second inclined surface, inclined to correspond with the first inclined surface, the second inclined surface being configured to move along the up-down direction along the first inclined surface according to a movement of the wire holder.

While the release button is pushed and the wire is pulled along a direction toward the handle, the wire holder may move along the direction toward the handle along the guide rail.

While the wire holder moves along the direction toward the handle, the fixing pipe may move upward while compressing the spring according to an upward movement of the second inclined surface along the first inclined surface of the wire holder, and the fixing protrusion may be released from the fixing groove.

While the release button is no longer pushed, the fixing pipe may move downward by a compression force of the spring, the first inclined surface of the wire holder may move along an opposite direction of the direction toward the handle along the second inclined surface of the fixing pipe, and the wire may be pulled along the opposite direction of the direction toward the handle by the wire holder such that the release button moves to an original position.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
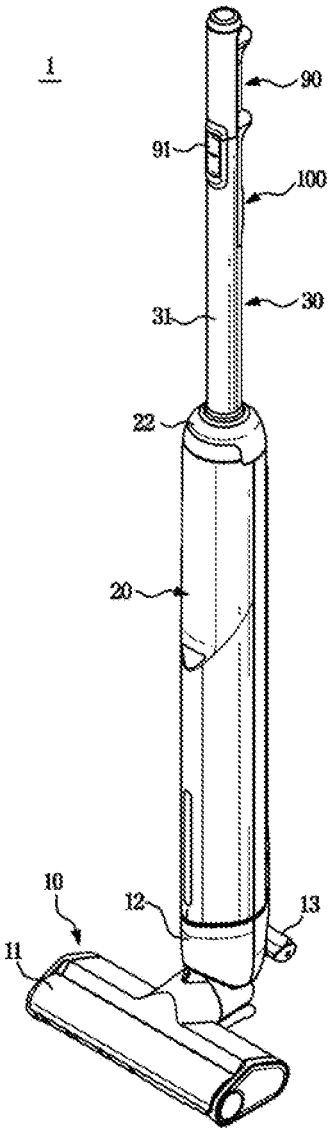
FIG. 1 is a perspective view of a cleaning device according to an embodiment of the disclosure.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

Also, the terms used in the present specification are merely used to describe the embodiments, and are not intended to limit and/or restrict the disclosure. An expression used in the singular encompasses the expression of the plural, unless it has a clearly different meaning in the context. In the present specification, it is to be understood that the terms such as "comprising", "including" or "having", etc., are intended to indicate the existence of the features, numbers, steps, operations, components, parts, or combinations thereof disclosed in the specification, and are not intended to preclude the possibility that one or more other features, numbers, steps, operations, components, parts, or combinations thereof may exist or may be added.

Also, it will be understood that, although the terms including ordinal numbers, such as "first", "second", etc., may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

In the following description, the terms "front end", "rear end", "upper", "lower", "front surface", "rear surface", "upper end", "lower end", etc. are defined based on the drawings, and the shapes and positions of the corresponding components are not limited by the terms.

An aspect of the disclosure provides a cleaning device in which a button for releasing a main body from a housing is provided on a handle.

Also, there is provided a cleaning device having an improved structure of a fixing device for fixing/releasing a main body to/from a housing such that the fixing device is provided as close as possible to a button.

According to embodiments of the disclosure, because a button for releasing a main body from a housing is provided on a handle, a user may operate the button with his/her hand gripping the handle while gripping the handle, resulting in an improvement of the user's convenience.

Hereinafter, embodiments of the disclosure will be described in detail with reference to the accompanying drawings.

Figure 2:
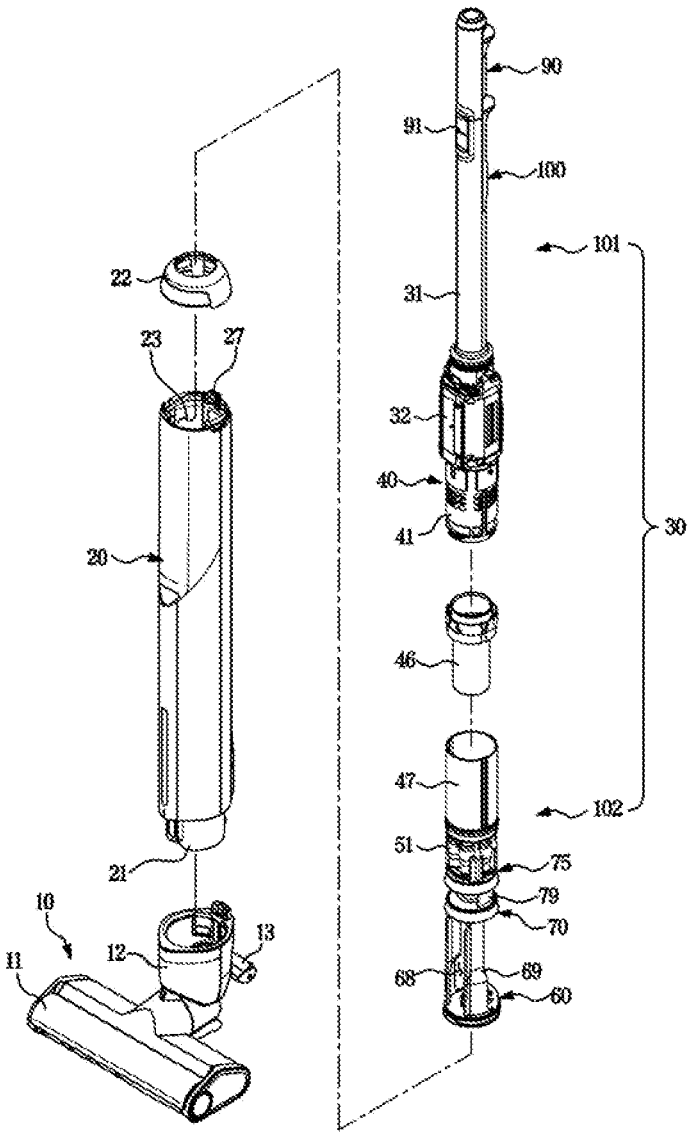
FIG. 2 is an exploded view of the cleaning device shown in FIG. 1 according to an embodiment of the disclosure.
Figure 3:
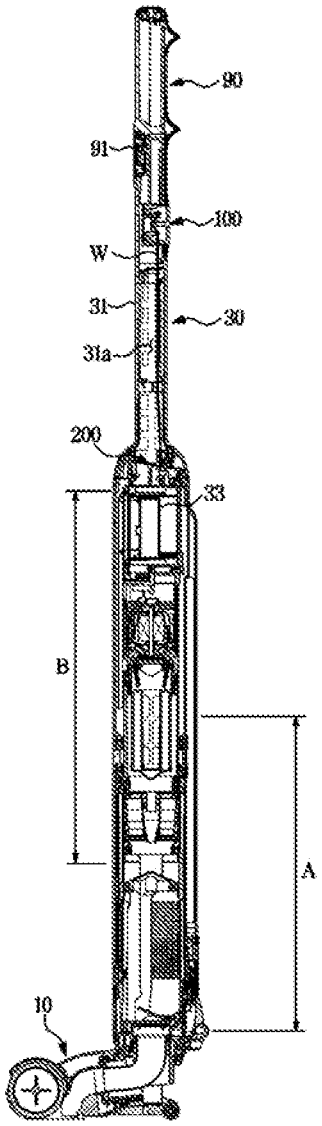
FIG. 3 shows a cross section of the cleaning device shown in FIG. 1 according to an embodiment of the disclosure.
Figure 4:
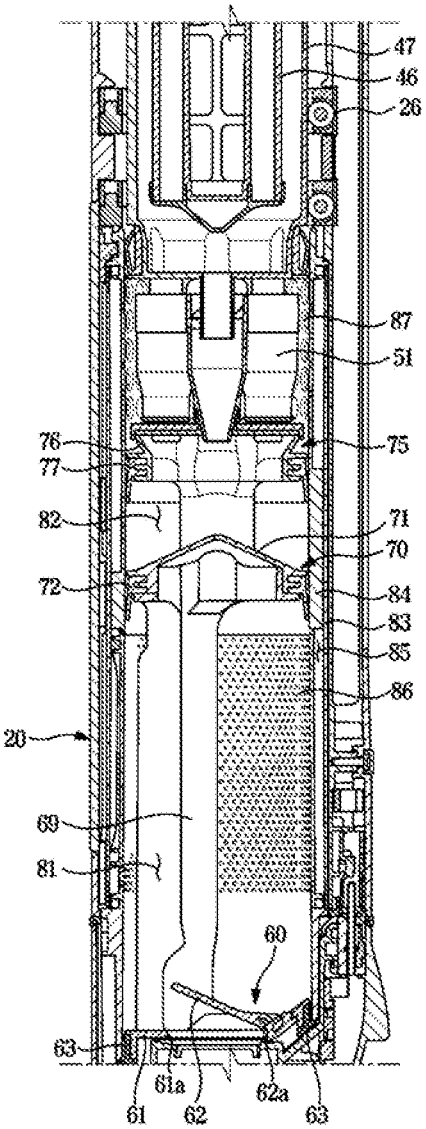
FIG. 4 is an enlarged view of an A area shown in FIG. 3 according to an embodiment of the disclosure.
Figure 5:
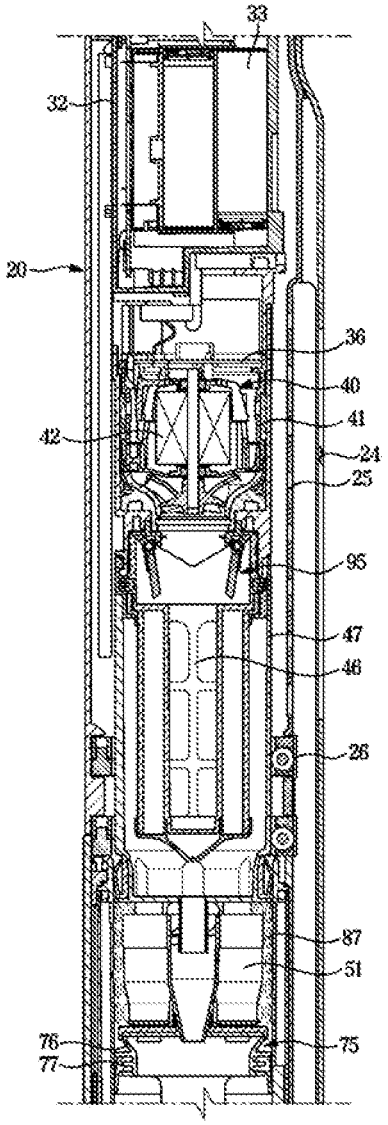
FIG. 5 is an enlarged view of a B area shown in FIG. 3 according to an embodiment of the disclosure.
Figure 6:
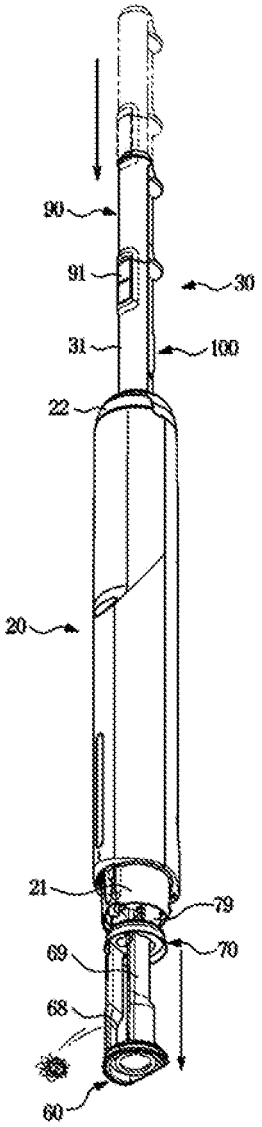
FIG. 6 shows an operation of emptying dust from the cleaning device shown in FIG. 1 according to an embodiment of the disclosure.

FIG. 1 is a perspective view of a cleaning device according to an embodiment of the disclosure. FIG. 2 is an exploded view of the cleaning device shown in FIG. 1. FIG. 3 shows a cross section of the cleaning device shown in FIG. 1. FIG. 4 is an enlarged view of an A area shown in FIG. 3. FIG. 5 is an enlarged view of a B area shown in FIG. 3. FIG. 6 shows an operation of emptying dust from the cleaning device shown in FIG. 1.

As shown in FIGS. 1 to 6, a cleaning device may include a suction head 10 for sucking rubbish such as hair, etc. on a floor to be cleaned by a suction force of air. The cleaning device may include a housing 20 connected to the suction head 10. The cleaning device may include a main body 30 that is movable inside the housing 20.

The suction head 10 may suck in rubbish such as dust existing on the surface to be cleaned, while moving on the surface to be cleaned. The suction head 10 may include a head assembly 11, a neck portion 12, and a head switch 13.

Inside the head assembly 11, an air flow path may be formed. The air flow path formed inside the head assembly 11 may communicate with the housing 20 through the neck portion 12. Outside air, rubbish, etc. received through the head assembly 11 may move to inside of the housing 20 via the neck portion 12.

The neck portion 12 may be connected to a lower end portion which is one end 21 of the housing 20. The neck portion 12 may be rotatably coupled to the head assembly 11. According to a rotation of the neck portion 12 with respect to the head assembly 11, the head assembly 11 may rotate with respect to the housing 20 connected to the neck portion 12. Accordingly, a degree of freedom of driving of the cleaning device may be improved.

The head switch 13 may fix or release a coupled state of the suction head 10 to the housing 20. A user may operate the head switch 13 to separate the suction head 10 from the housing 20. Because the head switch 13 is positioned in the suction head 10, the user may separate the suction head 10 from the housing 20 by operating the head switch 13 with his/her foot without bending at the waist.

The housing 20 may form a portion of an appearance of the cleaning device. The one end 21 of the housing 20 may be installed in the suction head 10. The main body 30 may be movably fixed to another end 22 of the housing 20. The housing 20 may include a cavity 23 in which the main body 30 is movably inserted.

The main body 30 may be slidingly fixed to the housing 20. The main body 30 may be released from the housing 20 to discharge rubbish, etc. filtered by a dust collecting chamber 81 and 82 provided inside the main body 30 to the outside. The main body 30 may be fixed to the housing 20 by a fixing device 200. The fixing device 200 may operate by a release button 100 provided in a handle 90. The fixing device 200 may be connected to the release button 100 by a wire W. The fixing device 200 may release the main body 30 from the housing 20 by the release button 100. Details about this will be described below.

The main body 30 may be movable between a first position of closing the dust collecting chamber 81 and 82 and a second position of opening the dust collecting chamber 81 and 82, with respect to the housing 20. A guide device 26 may be provided between the housing 20 and the main body 30. The guide device 26 may guide and support a movement of the main body 30 with respect to the housing 20.

The main body 30 may include an extension portion 31 forming a portion of the appearance of the cleaning device. Inside the extension portion 31, a space 31*a* for accommodating the wire extending toward a control switch 91 may be formed. The wire W connecting the release button 100 to the fixing device 200 may be accommodated in the space 31*a*.

The main body 30 may include the handle 90. The handle 90 may be positioned at a rear end portion of the extension portion 31. The handle 90 may be positioned at another end of the main body 30, the other end being opposite to one end in which an opening and closing device 60 is positioned. A user who uses the cleaning device may push or pull the suction head 10 by gripping the handle 90.

The handle 90 may include the control switch 91 for controlling operations of the cleaning device. The control switch 91 may receive a command for operating the cleaning device from a user. The control switch 91 may be positioned adjacent to the handle 90 to enable a user who performs cleaning to operate the control switch 91 while moving the cleaning device.

The main body 30 may include a battery installing portion 32. A battery 33 may be installed in the battery installing portion 32. One, two, or more batteries 33 may be provided. The battery installing portion 32 may be positioned inside the housing 20.

In the main body 30, a fan motor unit 40 for generating a suction force required to suck rubbish on a surface to be cleaned may be provided. The fan motor unit 40 may receive outside air through the suction head 10 and discharge the air through an exhaust port 24 and of the housing 20. The fan motor unit 40 may be installed in the main body 30 and positioned inside the housing 20. The fan motor unit 40 may include a fan motor 42.

According to coupling of the main body 30 to the housing 20, a first dust collecting chamber 81 and a second dust collecting chamber 82 may be formed in the cleaning device. More specifically, while the main body 30 is located at the first position with respect to the housing 20, the first dust collecting chamber 81 and the second dust collecting chamber 82 may be formed in the cleaning device.

An outer case 83 and an inner case 84, which form the dust collecting chambers 81 and 82, may be provided inside the housing 20, wherein the inner case 84 may be positioned inside the outer case 83. The outer case 83 may be positioned between the housing 20 and the inner case 84.

The outer case 83 may form a case flow path 85 together with the inner case 84. The case flow path 85 may guide air passed through the first dust collecting chamber 81 to the second dust collecting chamber 82.

The inner case 84 may be positioned inside the outer case 83. The first dust collecting chamber 81 may be formed inside the inner case 84. A filtering device 86 may be provided in the inner case 84. The first dust collecting chamber 81 may collect rubbish filtered from air received through the suction head 10 and passed through the filtering device 86.

The filtering device 86 may primarily filter rubbish from air received through the suction head 10. The filtering device 86 may extend along a portion of an inner side surface of the inner case 84. Rubbish filtered by the filtering device 86 may be collected in the first dust collecting chamber 81. The filtering device 86 may be provided as a mesh member.

The inner case 84 may include a case opening 87 through which air guided through the case flow path 85 enters a rubbish separating device 51.

Air entered the rubbish separating device 51 through the case opening 87 may be secondarily filtered in the rubbish separating device 51. Rubbish filtered by the rubbish separating device 51 may be collected in the second dust collecting chamber 82. Air filtered in the rubbish separating device 51 may move toward a motor filter 46.

The main body 30 may include the opening and closing device 60 for opening or closing the first dust collecting chamber 81. The opening and closing device 60 may be positioned at an end of the main body 30 toward the suction head 10. The opening and closing device 60 may interwork with a first rubbish removing member 70 and a second rubbish removing member 75.

Because the opening and closing device 60 interworks with the first rubbish removing member 70 and/or the second rubbish removing member 75, the opening and closing device 60 may prevent the first dust collecting chamber 81 from opening unintentionally and open the dust collecting chambers 81 and 82 only upon discharging of rubbish. The opening and closing device 60 may include an opening and closing member 61, an opening and closing cover 62, and an opening and closing sealing member 63.

The opening and closing device 60 may move, upon sliding and withdrawing of the first rubbish removing member 70 from the first dust collecting chamber 81, away from the housing 20 to open the first dust collecting chamber 81. Upon sliding and inserting of the first rubbish removing member 70 into the first dust collecting chamber 81, the opening and closing device 60 may move close to the housing 20 to close the first dust collecting chamber 81.

According to sliding of the main body 30 with respect to the housing 20, the opening and closing device 60 may open or close the first dust collecting chamber 81. The opening and closing device 60 may include a chamber inlet 61*a* through which air received from the suction head 10 enters the first dust collecting chamber 81. The chamber inlet 61*a* may be opened or closed by the opening and closing cover 62.

The opening and closing cover 62 may include a material having elasticity. The opening and closing cover 62 may open the chamber inlet 61*a* in a direction in which air enters the first dust collecting chamber 81. Meanwhile, the opening and closing cover 62 may not open the chamber inlet 61*a* in an opposite direction of the direction in which air enters the first dust collecting chamber 81. That is, upon suction of rubbish from a surface to be cleaned by the cleaning device, the opening and closing cover 62 may not open the chamber inlet 61*a* in a direction in which dust is discharged from the first dust collecting chamber 81, although the opening and closing device 60 opens the chamber inlet 61*a*. Accordingly, upon separating of the housing 20 from the suction head 10, rubbish may be prevented from being scattered.

The opening and closing cover 62 may include a cover hinge portion 62*a*. While the fan motor unit 40 generates a suction force, the opening and closing cover 62 may be elastically deformed in a fixed state of the cover hinge portion 62*a* to open the chamber inlet 61*a*. While the fan motor unit 40 generates no suction force, the opening and closing cover 62 may return to a position of closing the chamber inlet 61*a* by an elastic force.

The opening and closing sealing member 63 may seal between the inner case 84 and the opening and closing member 61. The opening and closing sealing member 63 may be positioned along an edge of the opening and closing member 61. The opening and closing sealing member 63 may include a material having elasticity. The opening and closing sealing member 63 may include a more flexible material than the opening and closing member 61. The opening and closing sealing member 63 may be in close contact with the inner side surface of the inner case 84 and seal the first dust collecting chamber 81. Accordingly, the cleaning device according to an embodiment of the disclosure may prevent rubbish from leaking out of the first dust collecting chamber 81.

The main body 30 may include the first rubbish removing member 70 for discharging rubbish of the first dust collecting chamber 81. The first rubbish removing member 70 may slide on the first dust collecting chamber 81. The first rubbish removing member 70 may include a first installing portion 71 and a first rubbish removing portion 72 installed in the first installing portion 71.

The first rubbish removing portion 72 may include a material having elasticity. The first rubbish removing portion 72 may be in close contact with an inner wall of the filtering device 86. The first rubbish removing portion 72 may be in close contact with a surface of the filtering device 86, on which rubbish is filtered. Upon sliding of the main body 30 with respect to the housing 20, the first rubbish removing portion 72 may slide while being in close contact with the inner surface of the filtering device 86. Upon sliding of the main body into the inside of the housing 20, the first rubbish removing portion 72 may remove rubbish such as tangled hair on the inner side surface of the filter device 186 by scratching the inner side surface of the filter device 186.

The first rubbish removing member 70 may move from a first position between the filtering device 86 and the rubbish separating device 51 up to a second position at which the first rubbish removing member 70 protrudes to the outside of the housing 20. Accordingly, the first rubbish removing member 70 may discharge rubbish existing in the first dust collecting chamber 81 to the outside. In addition, while the first rubbish removing member 70 protrudes to the outside of the housing 20, dust collected in the second dust collecting chamber 82 may also be discharged to the outside.

The main body 30 may include a plurality of first connecting portions 69 connecting the first rubbish removing member 70 to the opening and closing device 60. The first connecting portions 69 may be positioned in the first dust collecting chamber 81. The first rubbish removing member 70 may interwork with the opening and closing device 60 by the first connecting portions 69.

A discharge opening 68 may be formed between the plurality of first connecting portions 69. The discharge opening 68 may be formed between the first rubbish removing member 70 and the opening and closing device 60. While the opening and closing device 60 opens the first dust collecting chamber 81 and the first rubbish removing member 70 discharges rubbish of the first dust collecting chamber 81, the rubbish may be discharged to the outside through the discharge opening 68.

The main body 30 may include the rubbish separating device 51. The rubbish separating device 51 may include a cyclone. The rubbish separating device 51 may centrifuge rubbish not filtered in the first dust collecting chamber 81 from air. Because the rubbish separating device 51 separates rubbish from air passed through the filtering device 86 by another method than that used by the filtering device 86, the cleaning device according to an embodiment of the disclosure may raise cleaning efficiency.

The main body 30 may include the second rubbish removing member 75 for discharging rubbish of the second dust collecting chamber 82. The second rubbish removing member 75 may slide on the second dust collecting chamber 82 and the first dust collecting chamber 81. The second dust collecting chamber 82 may be formed between the first rubbish removing member 70 and the second rubbish removing member 75. The second rubbish removing member 75 may include a second installing portion 76 and a second rubbish removing portion 77 installed in the second installing portion 76.

The second rubbish removing portion 77 may include a material having elasticity. According to sliding of the main body 30 with respect to the housing 20, the second rubbish removing portion 77 may slide while being in close contact with the inner side surface of the inner case 84 to discharge rubbish of the second dust collecting chamber 82. According to sliding of the main body 30 with respect to the housing 20, the second rubbish removing portion 77 may slide while being in close contact with the inner side surface of the inner case 84 to empty all rubbish of the second dust collecting chamber 82.

The main body 30 may include a second connecting portion 79 connecting the first rubbish removing member 70 to the second rubbish removing member 75. The second connecting portion 79 may be positioned in the second dust collecting chamber 82. The second rubbish removing member 75 may interwork with the first rubbish removing member 70 by the second connecting portion 79.

In the main body 30, the motor filter 46 may be provided. The motor filter 46 may filter rubbish once more from air which has not yet entered the fan motor unit 40. The motor filter 46 may be positioned in front of the fan motor unit 40 in a direction in which air passed through the rubbish separating device 51 is discharged. The motor filter 46 may be positioned between the fan motor unit 40 and the rubbish separating device 51. The motor filter 46 may filter rubbish from air passed through the rubbish separating device 51. The motor filter 46 may be provided as a mesh member.

The motor filter 46 may be detachably installed in the filter case 47. The motor filter 46 may be positioned inside the housing 20 while being installed in the filter case 47 of the main body 30. The cleaning device according to an embodiment of the disclosure may prevent the fan motor unit 40 from being damaged by rubbish, etc. and discharge relatively clean air, through the motor filter 46.

The main body 30 may include a shutter device 95 for opening or closing a flow path through which air passed through the motor filter 46 moves to the fan motor unit 40.

The fan motor unit 40 may generate a suction force toward the first dust collecting chamber 81 and the second dust collecting chamber 82. Air passed through the motor filter 46 may pass through the fan motor unit 40 and then be discharged from the housing 20.

The cleaning device according to an embodiment of the disclosure may put a center of gravity at a relatively low location because the fan motor unit 40 having a relatively greater weight than the battery 33 is positioned at a lower location than the battery 33. Accordingly, the cleaning device according to an embodiment of the disclosure may raise ease of use because a center of gravity is relatively low.

In the cleaning device according to an embodiment of the disclosure, an area of the main body 30 where the fan motor unit 40 is positioned may be partitioned from the battery installing portion 32. That is, air flowing by the fan motor unit 40 may be discharged directly through a motor exhaust port 41 and the exhaust port 24 and 25 of the housing 20 without moving to the battery installing portion 32 and the handle 90. Accordingly, the cleaning device according to an embodiment of the disclosure may prevent discharged air from moving toward a user.

A controller 36 may be positioned between the fan motor unit 40 and the battery installing portion 32. The controller 36 may be provided as a Printed Board Assembly (PBA). The controller 36 may control operations of the cleaning device.

According to the above-described configuration, while the cleaning device according to an embodiment of the disclosure performs a cleaning operation, air received through the suction head 10 and including rubbish may be primarily filtered in the filtering device 86 of the first dust collecting chamber 81. Thereafter, the air may move to the rubbish separating device 51 through the case flow path 83 and then be secondarily filtered. The air filtered in the rubbish separating device 51 may be collected in the second dust collecting chamber 82. The air passed through the rubbish separating device 51 may pass through the motor filter 46 to be tertiarily filtered and then pass through the fan motor unit 40. The air passed through the fan motor unit 40 may be discharged through the motor exhaust port 41 and the exhaust port 24 and 25 of the housing 20.

To empty rubbish collected in the dust collecting chambers 81 and 82 after a cleaning operation terminates, the user may operate the fixing device 200 by pressing the release button 100 provided in the handle 90 to release the main body 30 from the housing 20. After the user releases the main body 30 from the housing 20, the user may slide the main body 30 with respect to the housing 20.

While the main body 30 slides inside the housing 20, the opening and closing device 60 positioned at one end portion of the main body 30 may open the first dust collecting chamber 81, the first rubbish removing member 70 may slide on one surface of the filtering device 86 on which rubbish exists, and the second rubbish removing member 75 may slide on the inner surface of the second dust collecting chamber 82 and the one surface of the filtering device 86 on which rubbish exists. The first rubbish removing member 70 may separate rubbish existing in the filtering device 86 and discharge the rubbish to outside of the first dust collecting chamber 81. The second rubbish removing member 75 may discharge rubbish of the second dust collecting chamber 82 to the outside while secondarily separating rubbish existing in the filtering device 86 to discharge the rubbish to the outside of the first dust collecting chamber 81.

For this, the first rubbish removing member 70 and the second rubbish removing member 75 may move to a position of protruding to the outside of the housing 20. Unlike this, the main body 30 may move such that only the opening and closing device 60 is exposed to the outside of the housing 20 and the first rubbish removing member 70 and the second rubbish removing member 75 are not exposed to the outside of the housing 20. Also, the main body 30 may move such that only the opening and closing device 60 and the first rubbish removing member 70 are exposed to the outside of the housing 20 and the second rubbish removing member 75 is not exposed to the outside of the housing 20.

Thereafter, after the dust collecting chambers 81 and 82 discharge dust, the user may move the handle 90 of the main body 30 in a direction of being away from the housing 20, and accordingly, the opening and closing device 60 may move to the position of closing the first dust collecting chamber 81.

According to the configuration, the cleaning device according to an embodiment of the disclosure may empty rubbish of the dust collecting chambers 81 and 82 by a relatively simple operation. In addition, because the opening and closing device 60 opens and closes the dust collecting chambers 81 and 82 only upon discharging of rubbish of the dust collecting chambers 81 and 82, rubbish may be prevented from being scattered while the housing 20 is separated from the suction head 10.

Figure 7:
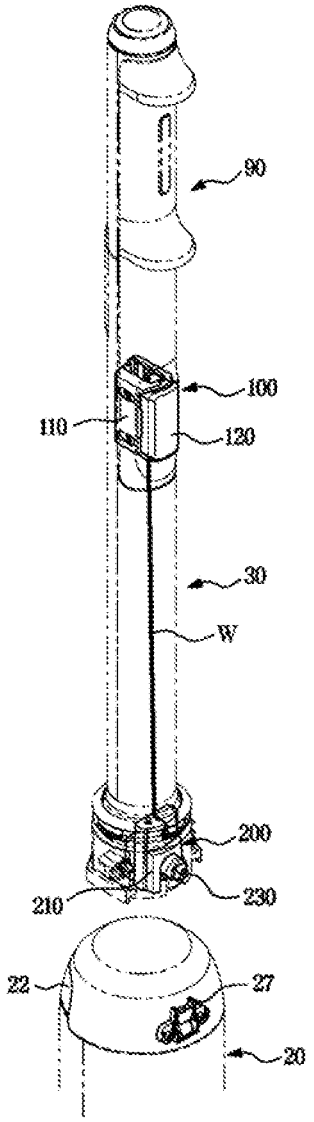
FIG. 7 shows a state in which a fixing device is connected to a release button by a wire in a cleaning device according to an embodiment of the disclosure.
Figure 8:
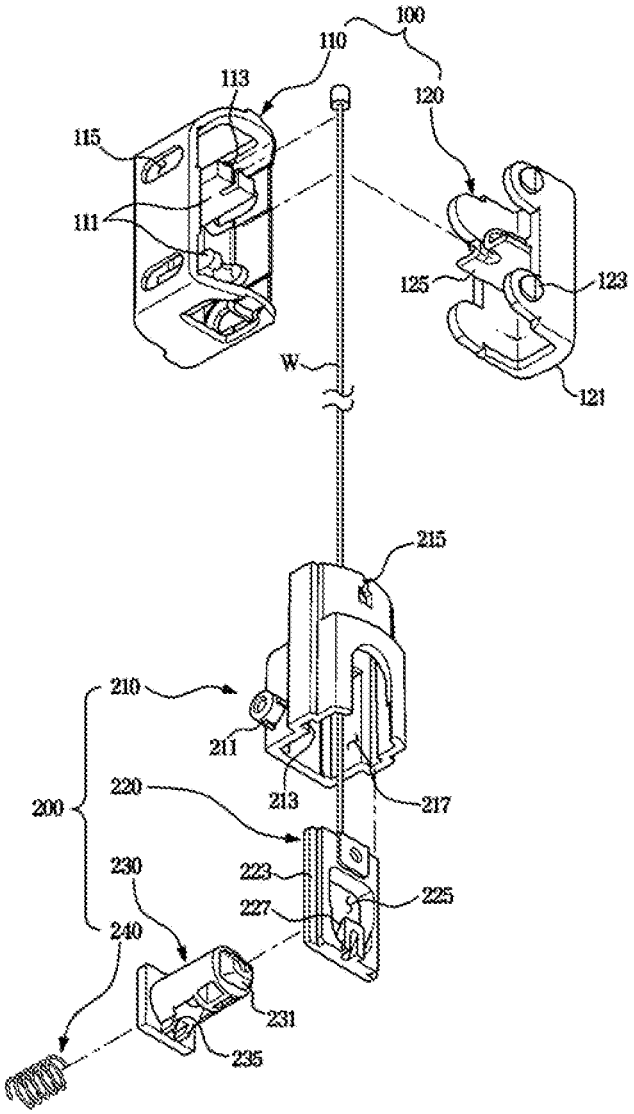
FIG. 8 is an exploded perspective view of a fixing device and a release button according to an embodiment of the disclosure.
Figure 9:
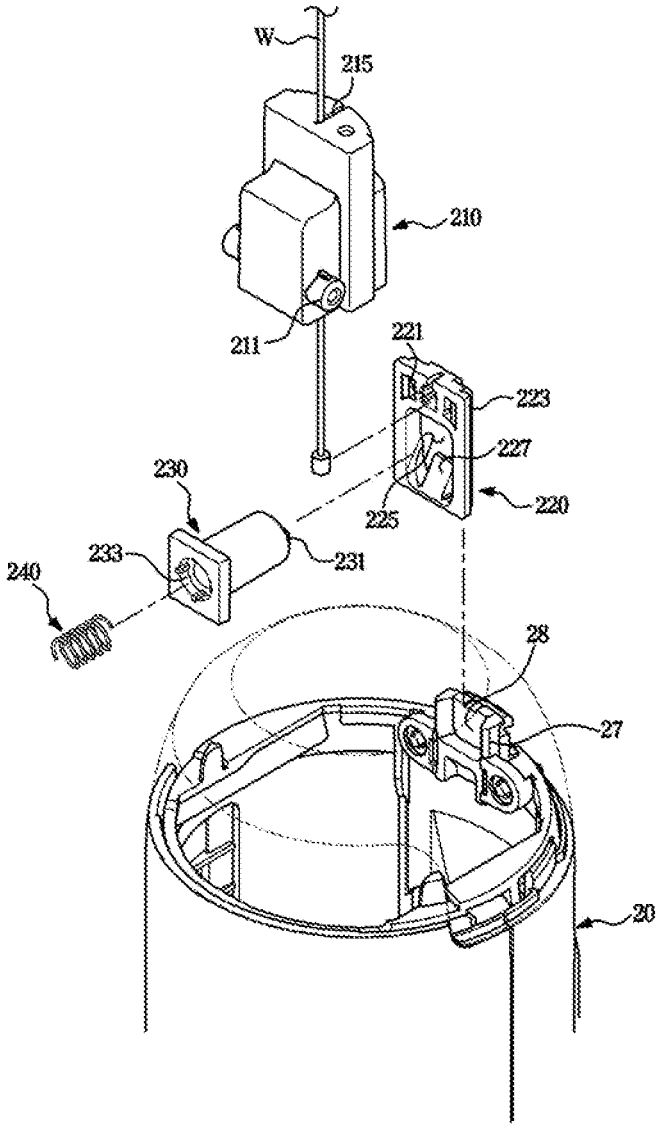
FIG. 9 is an exploded perspective view of a fixing device that is fixed to a fixing portion according to an embodiment of the disclosure.

FIG. 7 shows a state in which a fixing device is connected to a release button by a wire in a cleaning device according to an embodiment of the disclosure. FIG. 8 is an exploded perspective view of a fixing device and a release button according to an embodiment of the disclosure. FIG. 9 is an exploded perspective view of a fixing device that is fixed to a fixing portion according to an embodiment of the disclosure.

As shown in FIGS. 7 to 9, the cleaning device may include the release button 100 provided in the handle 90. The cleaning device may include the fixing device 200 connected to the release button 100 by the wire W. The fixing device 200 may be provided in the main body 30. The fixing device 200 may be provided at a location corresponding to the other end 22 of the housing 20, which is an end to which the main body 30 is fixed, to shorten a distance to the release button 100. That is, the fixing device 200 may be provided in the main body 30 at a location corresponding to a fixing portion 27 provided at the other end 22 of the housing 20.

The release button 100 may operate the fixing device 200 to fix/release the fixing device 200 to/from the fixing portion 27 of the housing 20. That is, the main body 30 may be fixed to or released from the housing 20 by the release button 100.

Because the release button 100 is provided in the handle 90, the user may release the main body 30 from the housing 20 by pressing the release button 100 with his/her hand gripping the handle 90. Accordingly, because the user is capable of pressing the release button 100 with his/her hand gripping the handle 90 while gripping the handle 90 with the hand, convenience may be improved.

The release button 100 may include a button case 110 fixed to the main body 30. The button case 110 may include a pair of support ribs 111 supporting the wire W. Because the support ribs 111 supporting the wire W are provided as a pair of pieces, a push rib 125 of a button portion 120 which will be described below may press the wire W between the pair of support ribs 111, which greatly increases a pulling distance of the wire W compared to a movement distance of the push rib 125.

The button case 110 may include a wire fixing portion 113 to which an end of the wire W is fixed. The wire fixing portion 113 may be provided at one of the pair of support ribs 111. The wire fixing portion 113 may be provided at a support rib 111 that is distant from the housing 20 among the pair of support ribs 111.

The button case 110 may include a guide hole 115 for guiding the button portion 120 to be movable with respect to the button case 110. A pair of guide holes 115 may be formed at each of both side walls of the button case 110. The guide hole 115 may be formed lengthily in a movement direction of the button portion 120 to guide a movement of the button portion 120. A guide protrusion 123 of the button portion 120 may be inserted in the guide hole 115. The button portion 120 may move with respect to the button case 110 by the guide protrusion 123 moving along the guide hole 115.

The release button 100 may include the button portion 120 movably fixed to the button case 110. The button portion 120 may include a push portion 121 exposed to the outside of the main body 30. The push portion 121 may be exposed to the outside of the handle 90 of the main body 30 such that the user is capable of pressing the push portion 121.

The button portion 120 may include the guide protrusion 123 for guiding the button portion 120 to move with respect to the button case 110. A pair of guide protrusions 123 may be formed at each of both side walls of the button portion 120. The guide protrusion 123 may be inserted in the guide hole 115 of the button case 110. While the user presses the push portion 121, the guide protrusion 123 may move along the guide hole 115 to press the button portion 120.

The button portion 120 may include the push rib 125 protruding from the push portion 121 and positioned between the pair of support ribs 111 of the button case 110. The push rib 125 may support the wire W. The push rib 125 may support the wire W in an opposite side of the pair of support ribs 111. That is, while the user presses the push portion 121, the push rib 125 may press the wire W to pull the wire W in the direction toward the wire fixing portion 113.

The housing 20 may include the fixing portion 27 having a fixing groove 28 to which the fixing device 200 is fixed. The fixing portion 27 may be provided at the other end 22 of the housing 20. According to fixing of the fixing device 200 to the fixing portion 27, the main body 30 may be fixed to the housing 20 to be prevented from moving. According to releasing of the fixing device 200 from the fixing portion 27, the main body 30 may be released from the housing 20 to be movable.

The fixing device 200 may include a holder case 210 coupled to the main body 30. The holder case 210 may include a coupling portion 211 that is coupled to the main body 30.

The holder case 210 may include a guide rail 213 for guiding a wire holder 220 to move with respect to the holder case 210. The guide rail 213 may be formed in both inner side walls of the holder case 210. A guide rib 223 of the wire holder 220 may be guided along the guide rail 213 and accordingly, the wire holder 220 may move with respect to the holder case 210.

The holder case 210 may include a penetration portion 215 which the wire W penetrates such that an end of the wire W is fixed to the wire holder 220. The wire W may penetrate the holder case 210 through the penetration portion 215 to be fixed to the wire holder 220.

The holder case 210 may include an opening 217 that opens to enable the wire holder 220 to move with respect to the holder case 210. The opening 217 may be formed in a side of the holder case 210, which is opposite to the penetrating portion 215. The wire holder 220 may be inserted in or withdrawn from the holder case 210 through the opening 217.

The fixing device 200 may include the wire holder 220 to which the end of the wire W is fixed and which is movably accommodated in the holder case 210. The wire holder 220 may include a wire fixing groove 221 to which the end of the wire W is fixed. According to pulling of another end of the wire W by the release button 100 after an end of the wire W is fixed to the wire fixing groove 221, the wire holder 220 may move in a direction toward the handle 90.

The wire holder 220 may include the guide rib 223 that is guided along the guide rail 213 of the holder case 210 to enable the wire holder 220 to move with respect to the holder case 210. The guide rib 223 may be formed in both side walls of the wire holder 220. The guide rib 223 may be inserted in the guide rail 213 of the holder case 210. The guide rib 223 may be guided along the guide rail 213 to move the wire holder 220 with respect to the holder case 210.

The wire holder 220 may include a through hole 225 which a fixing pipe 230 penetrates to be movable in an up-down direction with respect to the wire holder 220. The through hole 225 may be formed in a center portion of the wire holder 220. While the wire holder 220 moves with respect to the holder case 210 by the wire W, the fixing pipe 230 may move in the up-down direction through the through hole 225. The fixing pipe 230 may move in the up-down direction to be fixed to or released from the fixing groove 28 of the fixing portion 27.

The wire holder 220 may include a first inclined surface 227 for moving the fixing pipe 230 in the up-down direction while the wire holder 220 moves by the wire W in a state of being in contact with the fixing pipe 230. The first inclined surface 227 may be in contact with a second inclined surface 235 of the fixing pipe 230. The second inclined surface 235 may have a shape corresponding to the first inclined surface 227. Accordingly, according to sliding of the wire holder 220 by the wire W, the second inclined surface 235 of the fixing pipe 230 may move in the up-down direction along the first inclined surface 227 of the wire holder 220. Thereby, the fixing pipe 230 may move in the up-down direction to be fixed to or released from the fixing groove 28 of the fixing portion 27.

The fixing device 200 may include the fixing pipe 230 provided inside the holder case 210 and moving in the up-down direction with respect to the wire holder 220 while the wire holder 220 moves by the wire W. The fixing pipe 230 may include a fixing protrusion 231 that is fixed to the fixing groove 28 of the fixing portion 27. The fixing protrusion 231 may be fixed to the fixing groove 28 while the fixing pipe 230 moves downward with respect to the wire holder 220. While the fixing pipe 230 moves upward with respect to the wire holder 220, the fixing protrusion 231 may be released from the fixing groove 28.

The fixing pipe 230 may include a spring support portion 233 on which one side of a spring 240 which will be described below is supported. The spring support portion 233 may be formed at an opposite side of the fixing protrusion 231. One side of the spring 240 may be supported on the spring support portion 233, and another side of the spring 240 may be supported on the holder case 210. According to the upward movement of the fixing pipe 230 with respect to the wire holder 220, the spring 240 may be compressed.

The fixing pipe 234 may include the second inclined surface 235 corresponding to the first inclined surface 227 of the wire holder 220 and moving in the up-down direction along the first inclined surface 227 while the wire holder 220 moves. The second inclined surface 235 may be in contact with the first inclined surface 227 of the wire holder 220. The second inclined surface 235 may have a shape corresponding to the first inclined surface 227. Accordingly, while the wire holder 220 slides by the wire W, the second inclined surface 235 of the fixing pipe 230 may move in the up-down direction along the first inclined surface 227 of the wire holder 220. Thereby, the fixing pipe 230 may move in the up-down direction to be fixed to or released from the fixing groove 28 of the fixing portion 27.

The fixing device 200 may include the spring 240 provided between the fixing pipe 230 and the holder case 210. One side of the spring 240 may be supported on the spring support portion 233 of the fixing pipe 230, and another side may be supported on the holder case 210. Accordingly, while the fixing pipe 230 moves upward with respect to the wire holder 220, the spring 240 may be compressed. A compression force stored upon compression of the spring 240 may move the fixing pipe 230 downward with respect to the wire holder 220.

Figure 10:
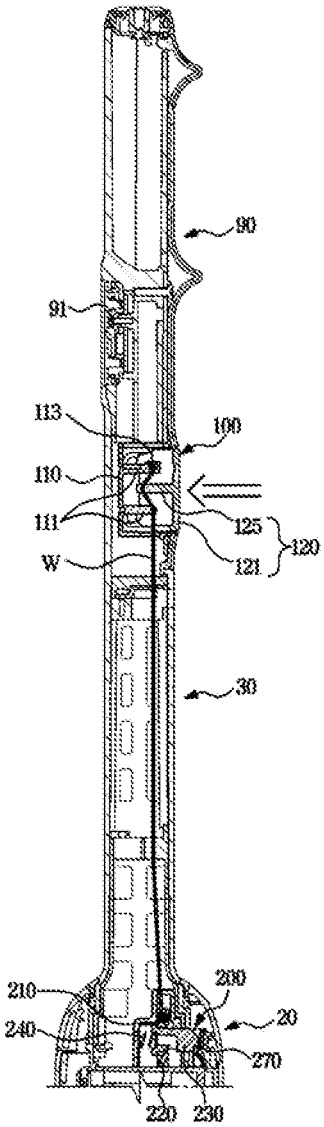
FIG. 10 is a cross-sectional view showing a state in which a fixing device is connected to a release button, according to an embodiment of the disclosure, by a wire.
Figure 11:
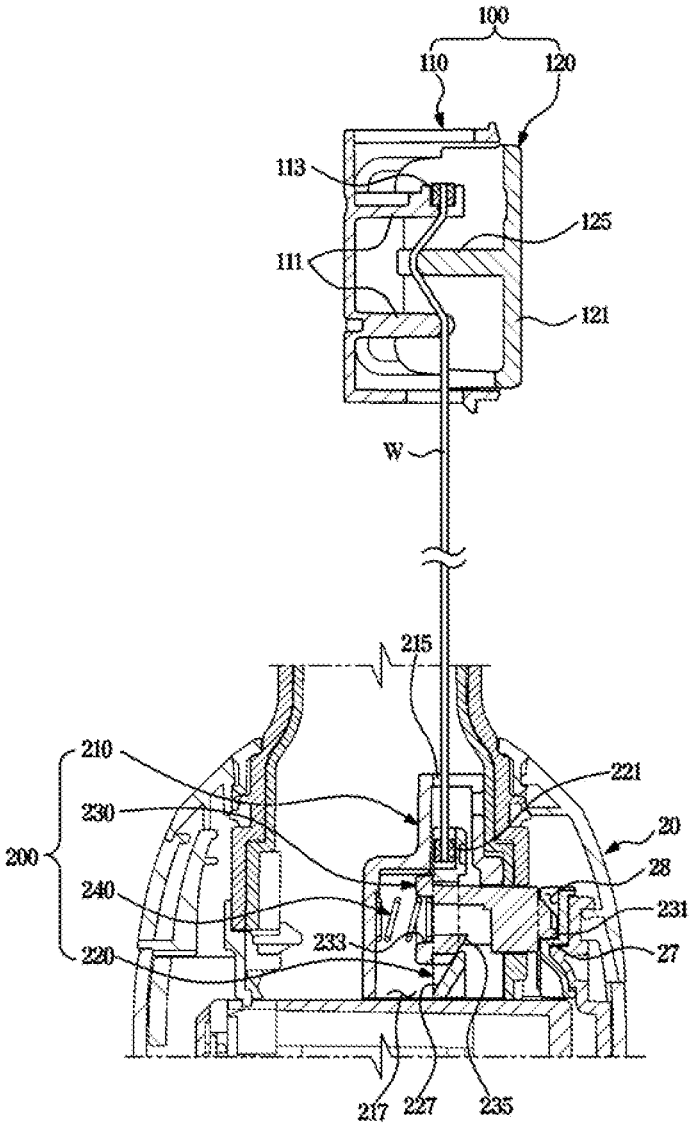
FIG. 11 shows a state in which a main body is fixed to a housing by fixing a fixing device, according to an embodiment of the disclosure, to a fixing portion.
Figure 12:
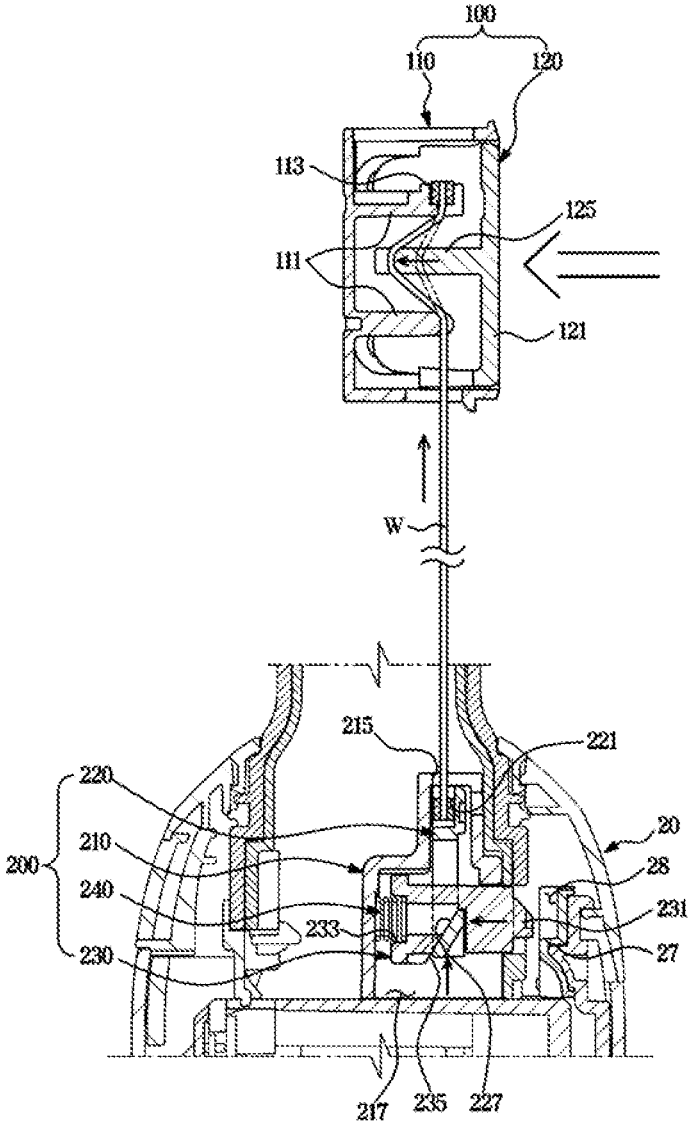
FIG. 12 shows a state in which a main body is released from a housing by releasing a fixing device from a fixing portion by a release button according to an embodiment of the disclosure.
Figure 13:
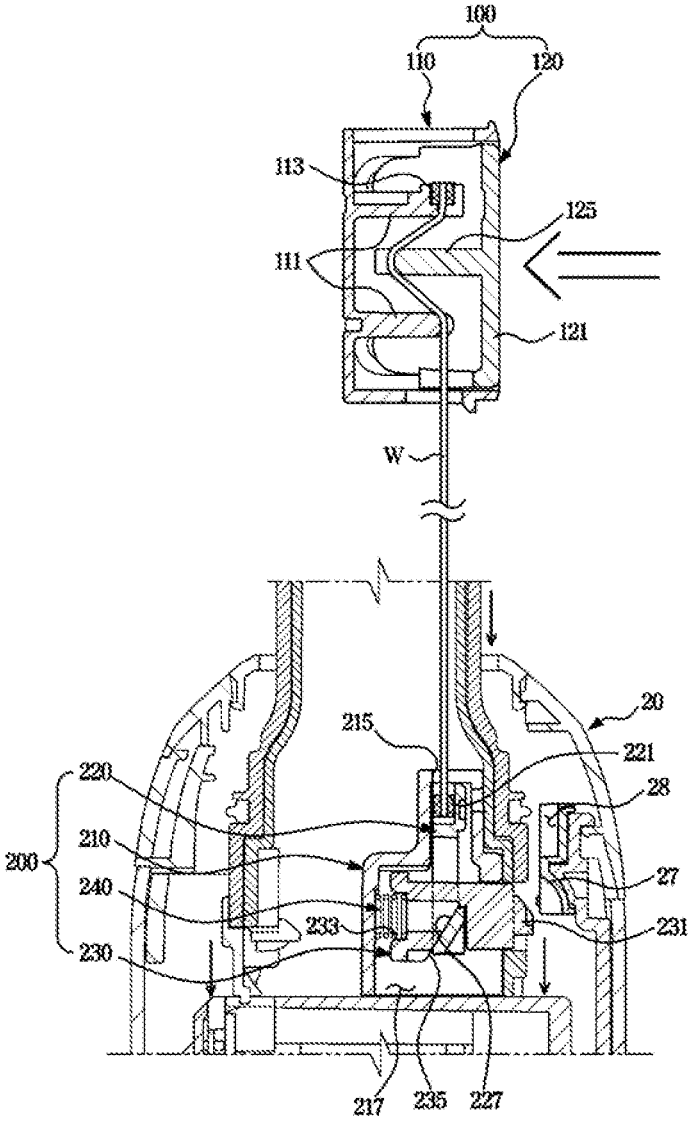
FIG. 13 shows a state in which a main body according to an embodiment of the disclosure is released from a housing and moves.

FIG. 10 is a cross-sectional view showing a state in which a fixing device is connected to a release button according to an embodiment of the disclosure by a wire. FIG. 11 shows a state in which a main body is fixed to a housing by fixing a fixing device according to an embodiment of the disclosure to a fixing portion. FIG. 12 shows a state in which a main body is released from a housing by releasing a fixing device from a fixing portion by a release button according to an embodiment of the disclosure. FIG. 13 shows a state in which a main body according to an embodiment of the disclosure is released from a housing and moves.

As shown in FIGS. 10 and 11, before the release button 100 is pressed, a user may perform cleaning by gripping the handle 90 because the main body 30 is fixed to the housing 20. That is, before the button portion 120 of the release button 100 is pressed, the main body 30 may be in a state of being fixed to the housing 20 because the fixing pipe 230 of the fixing device 200 is fixed to the fixing portion 27 provided in the housing 20. More specifically, because the fixing protrusion 231 of the fixing pipe 230 is fixed to the fixing groove 28 of the fixing portion 27, the main body 30 may be in a state of being fixed to the housing 20.

As shown in FIG. 12, while the button portion 120 of the release button 100 is pressed by a user, that is, while the user presses the push portion 121 of the button portion 120, the wire W may be pulled in the direction toward the wire fixing portion 113 to which an end of the wire W is fixed. At this time, because the push rib 125 presses the wire W between the pair of support ribs 111, a length by which the wire W is pulled may increase compared to a length by which the button portion 120 is pressed.

While the wire W is pulled in the direction toward the wire fixing portion 113, the wire holder 220 to which another end of the wire W is fixed may move in the direction toward the wire fixing portion 113. That is, the wire holder 220 may move in the direction toward the wire fixing portion 113 inside the holder case 210. According to the movement of the wire holder 220 in the direction toward the wire fixing portion 113, the second inclined surface 235 of the fixing pipe 230 being in contact with the first inclined surface 227 of the wire holder 220 may climb over the first inclined surface 227 and move upward with respect to the wire holder 220. According to the upward movement of the fixing pipe 230 with respect to the wire holder 220, the fixing protrusion 231 may be released from the fixing groove 28. According to the releasing of the fixing protrusion 231 from the fixing groove 28, the main body 30 may be released from the housing 20. According to the upward movement of the fixing pipe 230 with respect to the wire holder 220, the fixing pipe 230 may compress the spring 240.

In a state in which the main body 30 is released from the housing 20, the user may push the main body 30 toward the housing 20 to move the main body 30, as shown in FIG. 13. After the main body 30 moves toward the housing 20, rubbish, etc. filtered in the dust collecting chambers 81 and 82 provided inside the main body 30 may be discharged to the outside, as shown in FIG. 6.

After rubbish, etc. filtered in the dust collecting chambers 81 and 82 provided inside the main body 30 is discharged to the outside, the user may pull the main body 30 in an opposite direction of the direction toward the housing 20 to move the main body 30 to the inside of the housing 20, which is not shown in the drawings. The user may take off his/her hand from the button portion 120 after pulling the main body 30 until the main body 30 is no longer pulled, and in this case, the fixing pipe 230 may move downward with respect to the wire holder 220 by a compression force of the spring 240. According to the downward movement of the fixing pipe 230, the fixing protrusion 231 may be fixed to the fixing groove 28 of the fixing portion 27. According to the fixing of the fixing protrusion 231 to the fixing groove 28, the main body 30 may be fixed to the housing 20.

According to the downward movement of the fixing pipe 230 with respect to the wire holder 220, the first inclined surface 227 of the wire holder 220 may climb over the second inclined surface 235 of the fixing pipe 230 and thus, the wire holder 220 may move in the opposite direction of the direction toward the handle 90. According to the movement of the wire holder 220 in the opposite direction of the direction toward the handle 90, the wire W may be pulled in the opposite direction of the direction toward the handle 90 and thus, the button portion 120 may move to an original position before the button portion 120 is pressed by the user.

While the above descriptions about the cleaning device, given with reference to the accompanying drawings, are based on specific shapes and directions, various modifications and changes may be made by those of skilled in the art, and such various modification and changes should be interpreted to be included in the scope of rights of the disclosure.

What is claimed is:

1. A cleaning device comprising:

a housing including a dust collecting chamber therein;

a main body, moveable with respect to the housing, to be coupled to the housing and to be decoupled from the housing, the main body including a handle and a fan motor unit configured to generate a suction force;

a fixing device, arrangeable in the main body, to couple the main body to the housing while the main body is moved to a first position inside the housing and to decouple the main body from the housing while the main body is moved to a second position with respect to the housing; and a release button, arrangeable with respect to the main body, and connectable to the fixing device by a wire, so that while the release button is connected to the fixing device, the release button is useable to operate the fixing device, wherein the housing further comprises a fixing part having a fixing groove to which the fixing device is fixed, and wherein the fixing device includes:

a wire holder configured to be pulled by the wire, and a fixing pipe configured to be inserted into or separated from the fixing groove, wherein, the fixing pipe is configured to be guided along an inclined surface formed on the wire holder to be separated from the fixing groove based on a movement of the wire holder.

2. The cleaning device of claim 1, wherein, while the fixing device is arranged in the main body to couple the main body to the housing, the fixing device is positionable at an end of the housing to which the main body is to be coupled, and a distance between the end of the housing to the release button is shorter than a distance between another end of the housing to the release button.

3. The cleaning device of claim 1, wherein, while one end of the main body is coupled to the housing and accommodated inside the housing, the handle is at another end of the main body.

4. The cleaning device of claim 3, wherein the release button is at the handle adjacent to the other end of the main body.

5. The cleaning device of claim 1, wherein the release button comprises a button case fixed to the main body, and a button portion, moveable with respect to the button case, to be coupled to the button case and be decoupled from the button case.

6. The cleaning device of claim 5, wherein the button case comprises:

a pair of support ribs to support the wire, a wire fixing portion configured to fix an end of the wire to one of the pair of support ribs, and a guide hole configured to guide the button portion to be movable with respect to the button case.

7. The cleaning device of claim 6, wherein the button portion comprises:

a push portion exposed to an outside of the main body, a guide protrusion, insertable in the guide hole, the guide protrusion being configured to guide the button portion to be movable with respect to the button case, and a push rib to protrude from the push portion to be positioned between the pair of support ribs and support the wire.

8. The cleaning device of claim 1, wherein the fixing device further comprises:

a holder case couplable to the main body, a spring between the fixing pipe and the holder case, wherein:

the wire holder, to which an end of the wire is couplable, is moveable while accommodated in the holder case, and the fixing pipe, inside the holder case, is moveable along an up-down direction with respect to the wire holder based on a movement of the wire holder by the wire.

9. The cleaning device of claim 8, wherein the holder case comprises:

a coupling portion couplable to the main body, a guide rail configured to guide the wire holder to be movable with respect to the holder case, a penetration portion which the wire penetrates such that the end of the wire is coupled to the wire holder, and an opening which opens to enable the wire holder to move with respect to the holder case.

10. The cleaning device of claim 9, wherein the wire holder comprises:

a wire fixing groove to which the end of the wire is fixed, a guide rib, to be guided along the guide rail, the guide rib being configured to enable the wire holder to move with respect to the holder case, a through hole, which the fixing pipe penetrates, the fixing pipe being movable along the up-down direction, wherein the inclined surface is a first inclined surface configured to move the fixing pipe along the up-down direction according to the movement of the wire holder while being in contact with the fixing pipe.

11. The cleaning device of claim 10, wherein the fixing pipe includes:

a fixing protrusion fixed to the wire fixing groove, a spring support portion on which one side of the spring is supported, and a second inclined surface, inclined to correspond with the first inclined surface, the second inclined surface being configured to move along the up-down direction along the first inclined surface according to the movement of the wire holder.

12. The cleaning device of claim 11, wherein, while the release button is pushed and the wire is pulled along a direction toward the handle, the wire holder moves along the direction toward the handle along the guide rail.

13. The cleaning device of claim 12, wherein, while the wire holder moves along the direction toward the handle, the fixing pipe moves upward while compressing the spring according to an upward movement of the second inclined surface along the first inclined surface of the wire holder, and the fixing protrusion is released from the fixing groove.

14. The cleaning device of claim 13, wherein, while the release button is no longer pushed, the fixing pipe moves downward by a compression force of the spring, the first inclined surface of the wire holder moves along an opposite direction of the direction toward the handle along the second inclined surface of the fixing pipe, and the wire is pulled along the opposite direction of the direction toward the handle by the wire holder such that the release button moves to an original position.

* * * * *